United States Patent [19]

Norman

[11] 4,096,868

[45] Jun. 27, 1978

[54] SMOKING APPARATUS AND METHODS OF CONSTRUCTING AND UTILIZING SAME

[76] Inventor: Tom Norman, Flint, Mich.

[21] Appl. No.: 739,076

[22] Filed: Nov. 5, 1976

[51] Int. Cl.[2] ..... A24F 1/30

[52] U.S. Cl. ..... 131/173; 131/194

[58] Field of Search ..... 131/173, 194, 198

[56] References Cited

U.S. PATENT DOCUMENTS

| | | | |
|---|---|---|---|
| 1,513,147 | 10/1924 | Zahariadis | 131/173 |
| 3,863,646 | 2/1975 | Kahler | 131/173 |
| 3,882,875 | 5/1975 | Frost | 131/173 |
| 3,918,464 | 11/1975 | Kolodziej | 131/173 |
| 4,014,353 | 3/1977 | Kahler | 131/173 |

OTHER PUBLICATIONS

"Science and Invention" for Jul., 1927, p. 246.

*Primary Examiner*—Stephen C. Pellegrino
*Attorney, Agent, or Firm*—Irving M. Weiner

[57] ABSTRACT

A smoking apparatus which provides pleasing and mild tasting smoking sensation by first cooling and purifying smoke from a smokable product before the smoker inhales the smoke. The apparatus is designed so as to enable a liquid and/or ice cooling medium, which may include standard size ice cubes, to be placed in a bottle structure. A retainer which retains a smokable product so communicates with the bottle structure as to refrigerate and purify smoke in its journey from the retainer to the smoker's mouth.

5 Claims, 2 Drawing Figures

SMOKING APPARATUS AND METHODS OF CONSTRUCTING AND UTILIZING SAME

BACKGROUND OF THE INVENTION

1. Field of the Invention

The present invention relates generally to a device for effectively cooling and purifying smoke from a smokable product to provide a more pleasing effect for a smoker of such product.

In particular, the invention relates to a bottle structure which is capable of having liquid and/or ice cubes inserted therein which serve to eliminate much of the harsh effects caused by conventional smoking products.

The terminology "smokable product" as used herein is intended to include any conventional smoking product such as, for example, tobacco, marijuana, mesquite, leaves, grass, etc.

2. Description of the Prior Art

Heretofore there has not been developed any generally acceptable and workable smoking apparatus which effectively refrigerates, cools or purifies smoke from a smokable product before the smoke is inhaled by the smoker.

Exemplary of prior art attempts in this field is U.S. Pat. No. 77,096 issued in 1868 to H. R. Robbins entitled "Tobacco Pipe." The tobacco pipe disclosed therein provides for cooling of tobacco smoke by means of water and a diaphragm before it passes to the smoker.

Another prior art device is disclosed in U.S. Pat. No. 110,594 issued in 1870 to William Selfe entitlted "Improvement in Tobacco-Pipes." Such device incorporates a bowl surrounded by a casing, a water vessel, a pipe stem, a series of cocks or faucets, and a variety of other complex parts assembled in a complicated manner to perform the function of catching oil from tobacco smoke as it passes up to the smoker and also to cool the smoke.

Yet another device is disclosed in U.S. Pat. No. 1,579,703 issued in 1926 to A. D. Grant entitled "Smoking Device" which relates to a device used for cooling the smoke from a cigarette.

Each of the aforementioned devices, as well as other prior art smoking devices, are deficient in that they employ a whole array of complicated, difficult to manufacture and assemble, parts which are arranged in a very precise and complicated manner. Even with such complicated arrangements, however, the prior art devices are not effective in providing a pleasing and cool smoke for inhalation by a smoker.

The present invention successfully eliminates the disadvantages and shortcomings attendant the conventional prior art devices by providing a smoking apparatus which can be easily assembled and incorporates commonly available and simple parts which result in a very inexpensive and simple apparatus. The present invention is not limited to use by one person, can employ standard size ice cubes in the cooling medium, is highly efficient in its practical application, and is generally far more versatile and economical than any of the prior art devices.

SUMMARY OF THE INVENTION

The present invention provides a smoking apparatus for cooling and/or purifying smoke from a smokable product. The apparatus includes a main bottle structure for retaining fluids which has a closed bottom end and an open top end. The bottle structure is provided with a first aperture and a second aperture, with the first aperture having disposed therein a retainer for retaining at leaast one smokable product and the second aperture being used generally for ventilation purposes. The means for retaining the smokable product communicates with the interior of the main bottle structure preferably by way of a tube which may, for example, extend downwardly into the interior of the main bottle structure in close proximity with the closed bottom thereof. Means are also removably disposed in the open top end of the main bottle structure for selectively covering the open top end and also for receiving means for enabling smoke to be withdrawn from the bottle. The smoke withdrawal means might include, for example, elongated tubes having mouthpieces secured to the free ends thereof. The first and second apertures are both disposed below the means disposed in the open top end of the bottle structure. Also, the cross section near the open top end of the bottle structure is smaller than a similarly oriented cross section of the bottle structure near the closed bottom end of the bottle structure.

It is an object of the inventon that the main bottle structure includes a lower bottle portion and an upper bottle portion which are segmented from each other are are selectively engageable at open ends thereof. The bottle structure can be constructed from, for example, a commonly available beverage bottle, which is segmented to form the upper and lower bottle portions. The open bottom section of the upper bottle portion engages with the open top section of the lower bottle portion and each section can be provided with a peripheral sealing member to effectively join the two portions. Optionally, an airtight sealing gasket can be employed between the two sections to more effectively seal them together.

In accordance with a preferred embodiment of the invention, the open top section of the lower bottle portion is sufficiently large to enable standard size ice cube to pass therethrough, thus eliminating the necessity to first crush ice for use in the bottle. Further, the bottle structure is sufficiently large, and might constitute for example a beverage bottle, to enable a sufficient quantity of liquid and/or ice to be provided therein.

Other objects and details of the invention will become apparent from the following description, when read in conjunction with the accompanying drawings.

DETAILED DESCRIPTION OF PREFERRED EMBODIMENTS OF THE PRESENT INVENTION

Figure 1:
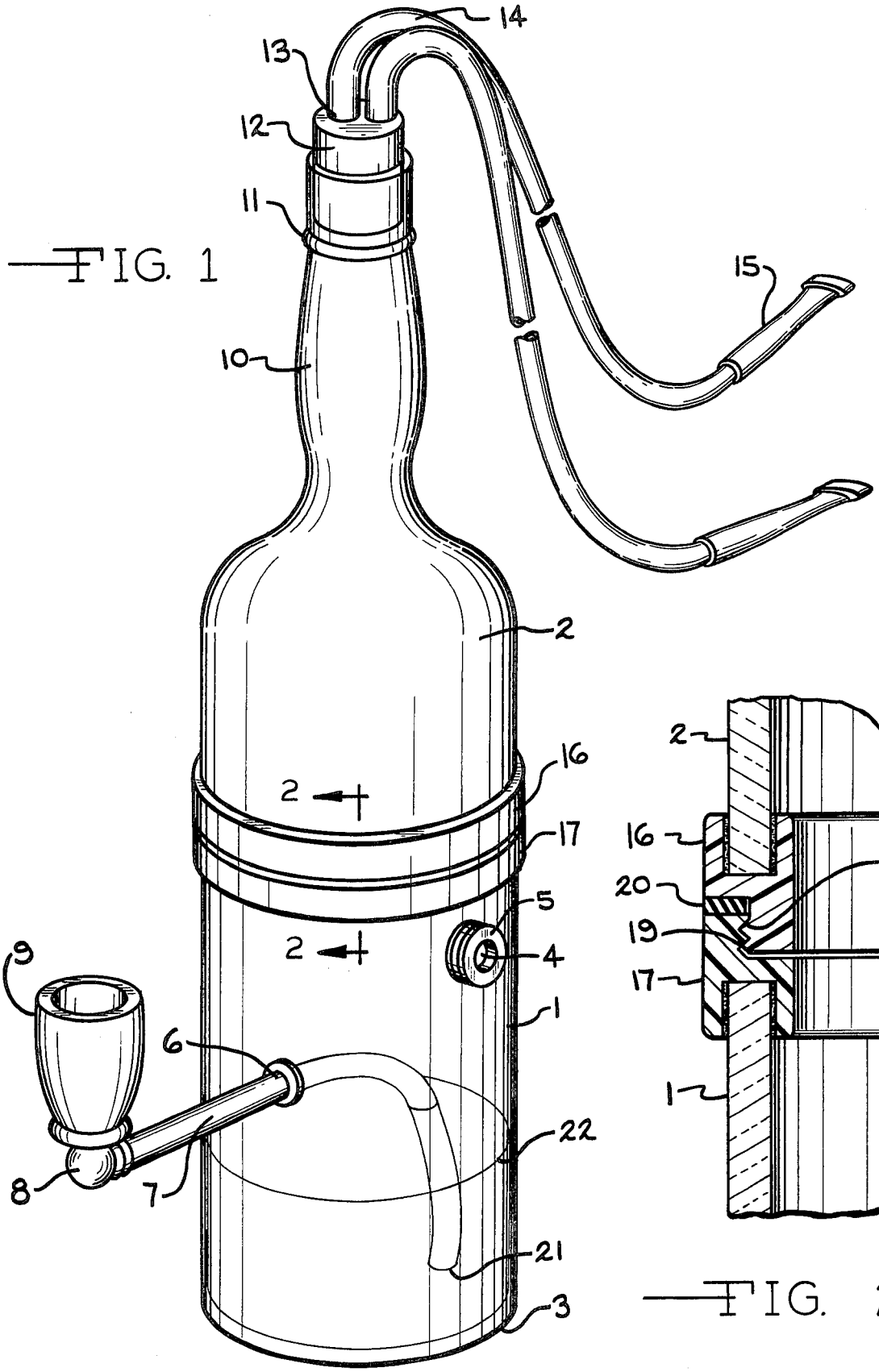
FIG. 1 depicts a front perspective view of a preferred embodiment of the smoking apparatus in accordance with the present invention.

With reference to FIG. 1, there is shown a first preferred embodiment of the present invention which includes a lower bottle portion 1 and an upper bottle portion 2, which, when placed in a juxtaposed manner as depicted, form a complete bottle structure. It should be noted that any conventional bottle can be employed for use in the invention, however, a bottle having an elongated neck portion as depicted is most desirable. Any commonly available bottle, such as a wine bottle, a soft drink bottle, a beer bottle, or bottles other than beverage bottles, can be practically employed. It should be noted, however, that the bottle should be of sufficient size to permit a substantial amount of liquid and/or ice to be placed therein.

As depicted in FIG. 1, the lower bottle portion 1 has a closed bottom end 3. An aperture 4 is disposed near the upper part of the lower bottle portion 1 and is incorporated for ventilation purposes. If desired, a grommet 5 can be placed in the aperture 4 to protect the edge of the bottle around the aperture and also for aesthetic purposes. The functioning of the ventilation aperture 4 will be described more fully hereinbelow.

The lower bottle portion 1 is further provided with an aperture 6 through which is disposed a tube or hose 7. Although the portion of the tube 7 which extends from the exterior of the bottle portion 1 is desirably rigid, the portion of the tube 7 which extends into the interior of the bottle portion 1 may be flexible if desired. Threadedly engaged with the outer end of the tube 7 is an elbow member 8 which in turn has threadedly engaged thereon a pipe bowl 9. If desired, the connections of the elbow member 8 need not be threaded, and can rather be glued, friction coupled, or fastened to the tube 7 and pipe bowl 9 in any desired manner. The inner end of the tube 7, as shown, bends downwardly into close proximity with the bottom 3 of the lower bottle portion 1.

The upper bottle portion 2 includes a neck portion 10 which terminates in an open top end 11 of the bottle structure. Disposed within the open top end 11 is a stopper 12 having at least one, but preferably a plurality, of through apertures 13 provided therethrough. Tightly secured within the apertures 13 are elongated tubes 14 which are preferably flexible. At the outer free ends of the tubes 14 are mouthpieces 15 which are inserted into the mouths of the smokers.

The open bottom section of upper bottle portion 2 and the open top section of lower bottle portion 1 are each provided with peripheral sealing members 16,17, respectively. In this connection, attention is drawn to FIG. 2.

Figure 2:
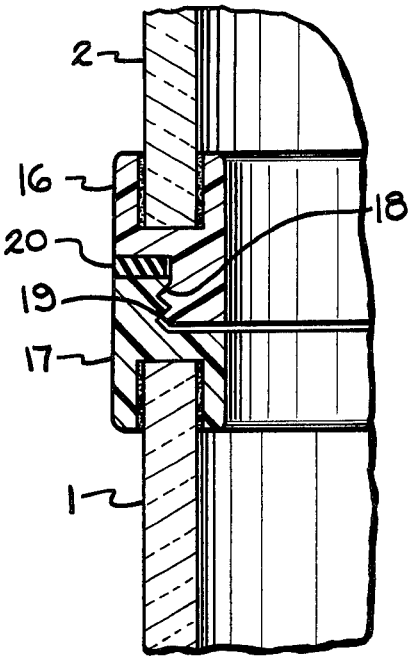
FIG. 2 illustrates a sectional view of the invention taken along line 2–2 in FIG. 1.

As depicted in FIG. 2, the peripheral sealing member 16 of the upper bottle portion 2 is grooved at 18 to interlock with corresponding grooves 19 provided in peripheral sealing member 17 of the lower bottle portion 1. To further effectively seal the bottle portions 1 and 2 together, there may be provided an airtight rubber gasket 20 between corresponding edges of the peripheral sealing members 16, 17. In this manner, the two bottle portions 1 and 2 are joined together to form an airtight substantially integral bottle structure when it is selectively desired to do so.

It should be noted that the two bottle portions 1 and 2 are easily formed by simply segmenting an ordinary bottle, such as a beverage bottle, into the two depicted portions 1 and 2.

The user of the apparatus first separates the bottle portions 1 and 2 in order to provide a large opening as provided by the open top section of lower bottle portion 1. The user then places any desired cooling medium which may include, for example, wine, beer, liquor, water, soft drink, carbonated water, or any other desired liquid medium or combination of liquids, and/or a desired number of standard size ice cubes, into the bottom of the lower bottle portion 1. It should be noted that the level of the combined ingredients in the cooling medium should be lower than the level of the aperture 4 in order to prevent escapement of the cooling medium out the aperture 4. Further, the cooling medium should reach a level higher than the end 21 of the tube 7, which is a simple matter since the end 21 is in close proximity to the bottom 3 of the lower bottle portion 1.

Next, the user places any desired smokable product, such as tobacco, into the pipe bowl 9. If desired, before inserting the smokable product, the user can first place a conventional circular screen member to serve as a filter and retaining means for the product within the pipe bowl 9. After the pipe bowl 9 has been filled with smokable product, the user can then replace the upper bottle portion 2 in positon of the lower bottle portion 1 as shown in FIG. 1. The stopper 12, which may be a cork stopper for example, is placed in the open top end 11 of the bottle having the desired number of elongated flexible tubes 14 extending from the apertures 13 therein.

At this point, the user ignites the smokable product within the pipe bowl 9. The smoke will travel along tube 7 and descend into the cooling medium 22. The smoke will then rise through the cooling medium equally all around the tube 7, thus being subjected completely to the action of the liquids and/or ice in the lower bottle portion 1. As the smoke rises through the cooling medium 22, much of its impurity is removed and the smoke is well refrigerated. The user or users of the apparatus, as the case may be, will enhale through the mouthpieces 15, drawing the smoke up through the lower bottle portion 1, upper bottle portion 2, the more confined area of the neck 10 and ultimately out through the elongated tubes 14 into the mouths of the smokers. In this manner, the smoke, in its journey from the pipe bowl 9 the the smoker's mouth, will be substantially cooled and purified and generally made more pleasing in taste and less harsh to the smoker.

The ventilation aperture 4 bill prevent the interior of the bottle structure from developing a vacuum effect, thus permitting a more even flow of smoke. For added variation, intermittent covering and uncovering the aperture 4 by the finger of the user will provide intermittent blasts of smoke from the exit tubes 14. Or, to temporarily slow down the burning effect during a period of non-use, a finger can be held continuously over the aperture 4.

The aforementioned operating steps for utilizing the smoking apparatus are not restricted to the sequential order presented herein, and any desired practical order of steps may be employed.

Due to the convenient disassembly characteristics of the bottle structure, it should be noted that the following very important features are arrived at. First, standard size ice cubes can be placed through the open top section of lower bottle portion 1 without the need of crushing the ice. Second, liquids can be easily placed in the lower bottle portion 1 through the open top section thereof. Also, the apparatus can be constructed from commonly available parts. In addition, when they are disassembled as above described, the various parts of the apparatus can be easily and effectively cleansed to provide continued effective performance of the apparatus.

It should be seen that the smoking apparatus of the present invention is simple in form and construction, economical to manufacture, easily assembled, and highly efficient in its practical application.

Further, the invention may be embodied in other specific forms without departing from the spirit or essential characteristics thereof. For example, it is contemplated that the bottle structure can be of integral construction, having an open top end sufficiently large enough to enable ice cubes to be passed therethrough.

The present embodiments are therefore to be considered in all respects as illustrative, and not restrictive. The scope of the invention is indicated by the appended claims rather than by the foregoing description.

I claim:

1. A smoking apparatus comprising:

an open top bottle of the commonly-available type having an elongated upper neck portion with a cross section substantially smaller than a similarly oriented cross section of said bottle near the bottom closed end of said bottle, said bottle being substantially of the same general configuration as a standard beverage bottle:

said bottle being segmented to form a lower bottle portion including a closed bottom end and an open top section large enough to enable standard size ice cubes to pass therethrough, and an upper bottle portion including an open top end and an open bottom section adapted to detachably engage said open top section of said lower bottle portion;

a first aperture provided in said lower bottle portion, said first aperture having removably disposed therein a tube extending from said first aperture;

said tube having detachably secured at the outer end thereof a pipe bowl for retaining therein at least one smokable product, while the inner end of said tube extends downwardly into the interior of said lower bottle portion into close proximity with said closed bottom end of said lower bottle portion so as to be submerged within a liquid and/or ice cooling medium selectively disposed in said lower bottle portion for cooling smoke which passes from said smokable product through said tube into said lower bottle portion;

a second aperture provided in said lower bottle portion, said second aperture being disposed above the level of said cooling medium to serve as a ventilation hole for said apparatus;

a removable stopper member disposed in said open top end of said upper bottle portion to substantially cover and seal said open top end;

said stopper member having provided therethrough at least one aperture; and a tube provided in said aperture of said stopper member and extending outwardly therefrom to enable a user of said smoking apparatus to inhale smoke therethrough.

2. A smoking apparatus in accordance with claim 1, wherein;

at the junction of said open top section of said lower bottle portion and said open lower section of said upper bottle portion there is provided an airtight sealing gasket.

3. A smoking apparatus in accordance with claim 1, wherein:

said open bottom section of said upper bottle portion and said open top section of said lower bottle portion are each provided with a peripheral sealing member which are adapted to interengage with each other.

4. A smoking apparatus in accordance with claim 3, wherein:

at the junction of said open top section of said lower bottle portion and said open lower section of said upper bottle portion there is provided an air tight sealing gasket.

5. A smoking apparatus in accordance with claim 1, wherein:

said stopper is constructed of cork; and said smoke inhaling tube is provided at the free end thereof with a substantially rigid mouthpiece.

* * * * *